United States Patent [19]

Pole et al.

[11] Patent Number: 4,925,115

[45] Date of Patent: May 15, 1990

[54] SUGAR CANE MILL

[75] Inventors: Kishor M. Pole; Bhagawan S. Dhavlikar, both of Maharashtra, India

[73] Assignee: Walchandnagar Industries Limited, Bombay, India

[21] Appl. No.: 347,459

[22] Filed: May 4, 1989

[51] Int. Cl.[5] ..... B02C 4/02

[52] U.S. Cl. ..... 241/222; 241/231

[58] Field of Search ..... 241/101.2, 222, 166, 241/225, 167, 230–235, 293, 294, 285 R

[56] References Cited

U.S. PATENT DOCUMENTS 4,561,156 12/1985 Sun ..... 241/294 X

FOREIGN PATENT DOCUMENTS 2069869 7/1983 United Kingdom .

*Primary Examiner*—Mark Rosenbaum

*Attorney, Agent, or Firm*—Ladas & Parry

[57] ABSTRACT

An improved sugar cane mill having a mill housing with a pair of spaced apart frames fixed to the ground, a feed roller, a top roller and a discharge roller extending between the frames in a spaced apart relationship. The mill has a trash plate disposed and extending between the feed roller and discharge roller. The feed roller is independently loaded with constant pressure imparting means and is movable up and down substantially linearly along with the trash plate mounted thereon responsive to change in feed and the trash plate orientation with respect to confronting top roller surface is maintained at all positions of the feed roller. Consequently, the gap between top roller and tail-end of the trash plate reduce or increases in direct proportion to the gap between the top roller and lead-end of the trash plate thereby eliminating chances of choke-up of the feed between the top roller and tail-end of the trash plate and rolling of the feed over the tail-end of the trash plate instead of getting transferred onto the discharge roller.

12 Claims, 9 Drawing Sheets

FIG. 2
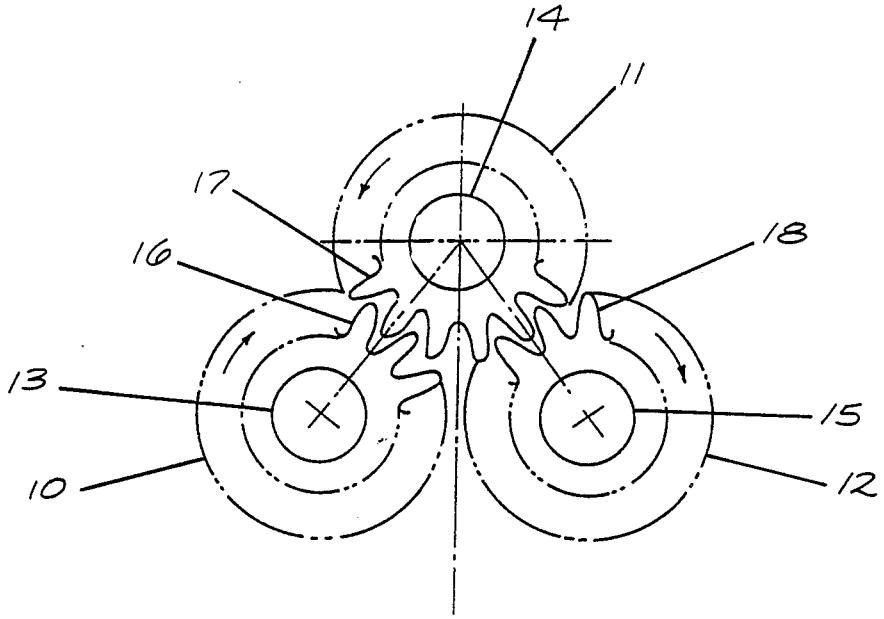
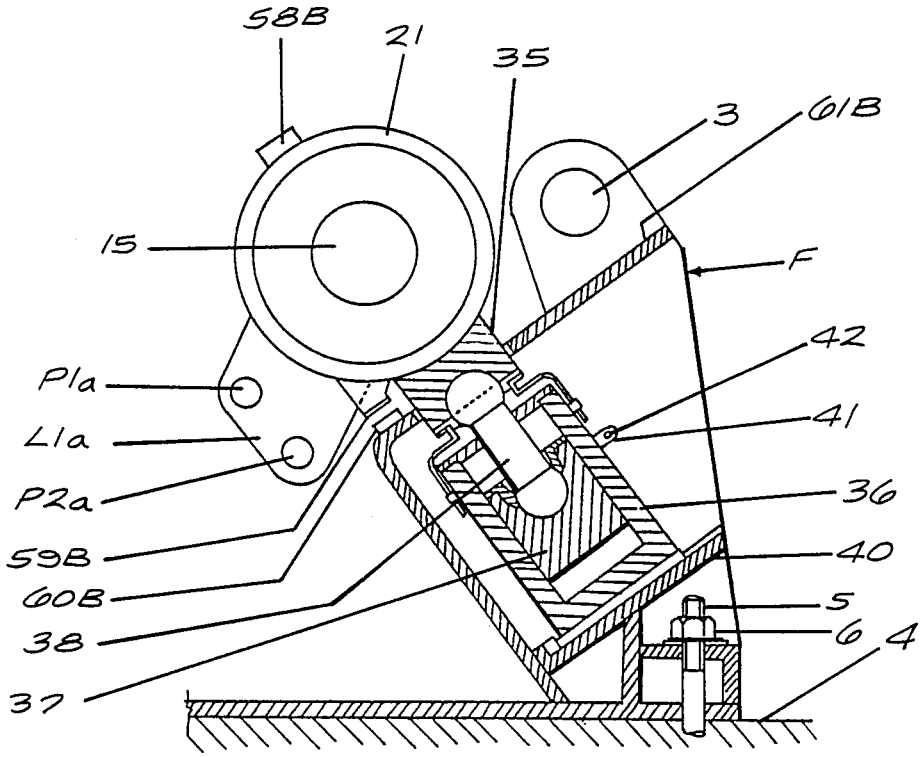
FIG. 6

SUGAR CANE MILL

This invention is concerned with improvements in or relating to sugar cane mills.

Several types of sugar cane mills are known. One type of such mills comprises a feed roller, a top roller, a discharge roller and a housing including two upstanding spaced apart frames between which said rollers extend, the axes of said rollers being parallel to one another, bearings at opposite ends of the top roller being carried respectively by the two upstanding frames, bearings at opposite ends of the feed roller being mounted respectively in first chairs which are mounted for pivotable movement by first power operated means to vary the feed opening between the feed roller and the top roller, and bearings at opposite ends of the discharge roller being mounted respectively in second chairs which are mounted for pivotable movement by second power operated means to vary the discharge opening between the discharge roller and the top roller, said mill including a trash plate for transferring bagasse between the feed opening and the discharge opening, the trash plate being disposed between the feed roller and discharge roller and abutting the feed roller and biased towards the feed roller and connected to said first chairs for movement therewith (British Patent No. 2069869B).

One of the drawbacks of this type of mill is that both the first chairs and second chairs are mounted for pivotable movement on bifurcated portions (See the drawings of British Patent No. 2069869B). Consequently the floating movement (up and down movement) of the feed roller in association with the first chairs or the discharge roller in association with the second chairs responsive to change in feed (bagasse) rate with respect to the single pivot provided by the bifurcated portions will be in an arc of a circle. Consequently the trash plate connected to the first chairs for movement therewith will also move in an arc of a circle. But during the up and down movement of the trash plate, its orientation with respect to the confronting top roller surface will not be maintained because of the single pivot based trash plate floating arrangement. Thus, when the feed roller moves down responsive to increase in feed rate, the lead-end of the trash plate will move down and the tail-end of the trash plate will move up. Consequently the gap between the lead-end of the trash plate and top roller will increase, whereas the gap between the tail-end of the trash plate and top roller will reduce. This may lead to choke up of the feed between the top roller and tail-end of the trash plate. When the feed roller moves up responsive to decrease in feed rate, lead-end of the trash plate will move up and tail-end of the trash plate will move down. Consequently the gap between the top roller and lead-end of the trash plate will reduce, whereas the gap between the top roller and tail-end of the trash plate will increase. This may cause the feed to roll over the tail-end of the trash plate instead of getting transferred on to the discharge roller.

Another drawback of this type of mill is that the axis passing through the trash plate pivot points and feed roller axis do not remain parallel to each other during the floating movement of the trash plate due to the single pivot based floating arrangement thereof. Consequently there will not be any cocking of the feed roller and trash plate and if at all any cocking occurs then the trash plate will loose its contact with the feed roller at either end disturbing the set scrapping contact and scrapping pressure between the feed roller and trash plate and there could be mechanical failure of components associated with the trash plate mounting.

Another drawback of this type of mill is that during floating movement of the feed roller or discharge roller, the resultant surface speed of the respective roller will be the arithmatic sum of its own speed and its angular speed of floatation with respect to the pivot of the respective chair. When the roller floats in the direction of its rotation the resultant surface speed will be its own speed and its angular speed of floatation. When the roller floats in the direction opposite to its direction of rotation, the resultant surface speed will be its own speed minus its angular speed of floatation. As a result of the variation in the surface speed, there could be shearing or slippage of bagasse depending on actual friction between the roller and bagasse ultimately resulting in wastage of power or reduced mill capacity.

Another drawback of this type of mill is that water cooled gun metal bearings used for feed and discharge rollers (See the drawings of British Patent No. 20698698) cannot be interchanged with antifriction bearings because of the mill construction being such that it cannot accomodate antifriction bearings. Antifriction bearings require larger space but are desirable to reduce frictional power losses.

Another drawback of this type of mill is that the components used for floating the feed and discharge rollers allow up and down movement of the feed and discharge rollers and the configuration thereof are very complicated and their manufacture and assembly are also complicated.

To the best of our knowledge the mill of the above British Patent has not been commercially manufactured and this may possibly be due to the above drawbacks.

The object of the present invention is to obviate the abovementioned drawbacks and provide an improved sugar cane mill.

According to the present invention there is thus provided an improved sugar cane mill comprising a mill housing consisting of a pair of spaced apart upright frames fixed to the ground, a feed roller, a top roller and a discharge roller extending between said frames in a spaced apart relationship, the axes of said feed roller, top roller and discharge roller being parallel to one another, said mill including a trash plate disposed and extending between said feed roller and discharge roller, said feed roller being rotatably supported in a first pair of bearings, the housings of said first pair of bearings each being provided with a lateral lug at the bottom thereof towards the trash plate side, the trash plate side of the housings of said first pair of bearings being supported on the respective frames by at least one pair of first parallelogram link mechanisms, the pivot axes of said first parallelogram link mechanisms being parallel to the axis of said feed roller, said first parallelogram link mechanisms guiding the up and down movement of the housings of said first pair of bearings, and the feed roller substantially linearly, the housings of said first pair of bearings being supported on and moved up and down by a pair of first constant pressure imparting means accommodated in the respective frames, said discharge roller being rotatably supported in a second pair of bearings, the trash plate side of the housings of the second pair of bearings being supported on the respective frames by at least one pair of second parallelogram link mechanisms, the pivot axes of said second parallelogram link mechanisms being parallel to the axis of said discharge roller, said second parallelogram link mechanisms guiding the up and down movement of the housings of said second pair of bearings and the discharge roller substantially linearly, the housings of said second pair of bearings being supported on and moved up and down by a pair of second constant pressure imparting means accommodated in the respective frames, said top roller being rotatably supported in a third pair of bearings, the housings of said third pair of bearings being mounted in said frames, the drive end of said top roller being coupled to a prime mover such as steam turbine or electric or hydraulic motor through the tail bar and box coupling assembly and gearing, the position of said top roller being fixed during operation of said mill, said trash plate being pivotally supported on said lateral lugs and abutting said feed roller and biased towards said feed roller, the axis passing through the pivots of said trash plate being parallel to the feed roller axis, said trash plate being movable up and down with said feed roller maintaining the set scrapping contact with said said feed roller and the orientation thereof with respect to the confronting top roller surface, first stoppers being provided at the bottom of the housings of said third pair of bearings and at the confronting upper surface of the housings of said first pair of bearings and second pair of bearings to limit the upward movement of said feed roller and discharge roller, and second stoppers being provided at the bottom of the housings of said first pair of bearings and said second pair of bearings and at the confronting surfaces of said frames to limit the downward movement of said feed roller, and said discharge roller.

According to an embodiment of the present invention, each of said frames is double walled and comprises a lower part and an upper part removably fitted to the lower part.

According to an embodiment of the present invention, each of said first and second pressure imparting means includes hydraulic cylinder with ram and stem and a constant rate recirculating type hydraulic pump connected to said hydraulic cylinder, and the housing of each of the first pair of bearings and second pair of bearings is provided with a pair of spaced apart downward projections depending from the bottom thereof said cylinder being provided with lifting bracket with hole and located between the walls of said lower part, the walls of said lower part being engaged between said downward projections.

According to an embodiment of the present invention, each of the top end and bottom end of said stem is spherical, the spherical top end of said stem being engaged in a spherical socket provided in a seat at the bottom of the housing of each of the first and second pair of bearings to provide a universal joint or coupling between the stem and respective bearing housing and the spherical bottom end of said stem being engaged in another spherical socket provided in said ram to provide a universal joint or coupling between said stem and said ram.

According to an embodiment of the present invention, said frames are fixed to the ground using foundation bolts accessible from outside of said frames.

According to an embodiment of the present invention said frames are provided with lifting brackets with holes.

According to an embodiment of the present invention, each of said first pair of bearings and second pair of bearings is a babit lined spherical seat bearing adapted to be interchangeable with a spherical antifriction bearing.

According to an embodiment of the present invention, said babit lined spherical seat bearing consists of an inner race provided with a babit lining at the inner surface thereof and coolant jackets therein and a convex outer surface and an outer race provided with a concave inner surface corresponding to the convex outer surface of said inner race and located on said inner race, said bearing including a locating ring enclosing said bearing and adapted to be located in the respective bearing housing and associated with an O-ring to seal said bearing against leakage thereinto when mounted on the shaft of the respective feed or discharge roller, a clearance being provided between said outer race and said locating ring to obtain sufficient play between said outer race and said locating ring along the axis of the respective roller to facilitate cocking of the respective roller and the housings of said first pair of bearings each is provided with a L-shaped lug at the bottom thereof spaced apart from said lateral lug and said trash plate includes a turnbeam which is pivotally supported on said lateral lugs through trunnions using pins and spherical plain bearings housed in said lateral lugs, said trash plate being spring biased towards said feed roller by loading a spring at one end of a lever supported in said L-shaped lug, the other end of said lever being pivoted on the turn beam of said trash plate, sufficient space being provided between said lateral lugs and said spherical plain bearings along the axis passing through said spherical plain bearings in parallel to the feed roller axis to allow play between said spherical plain bearings and said lateral lugs and facilitate cocking of said trash plate along with the feed roller.

According to an embodiment of the present invention, said inner race is mounted on a removable sleeve located on the shaft of the respective feed or discharge roller.

The present invention is described hereinbelow with reference to the accompanying drawings, in which:

FIG. 2 is view of the pinions of the mill of FIG. 1 from drive side in the direction 'A' in FIG. 1;

FIG. 6 is section at E—E in FIG. 1 through the discharge roller and associated hydraulic cylinder;

Figure 4:
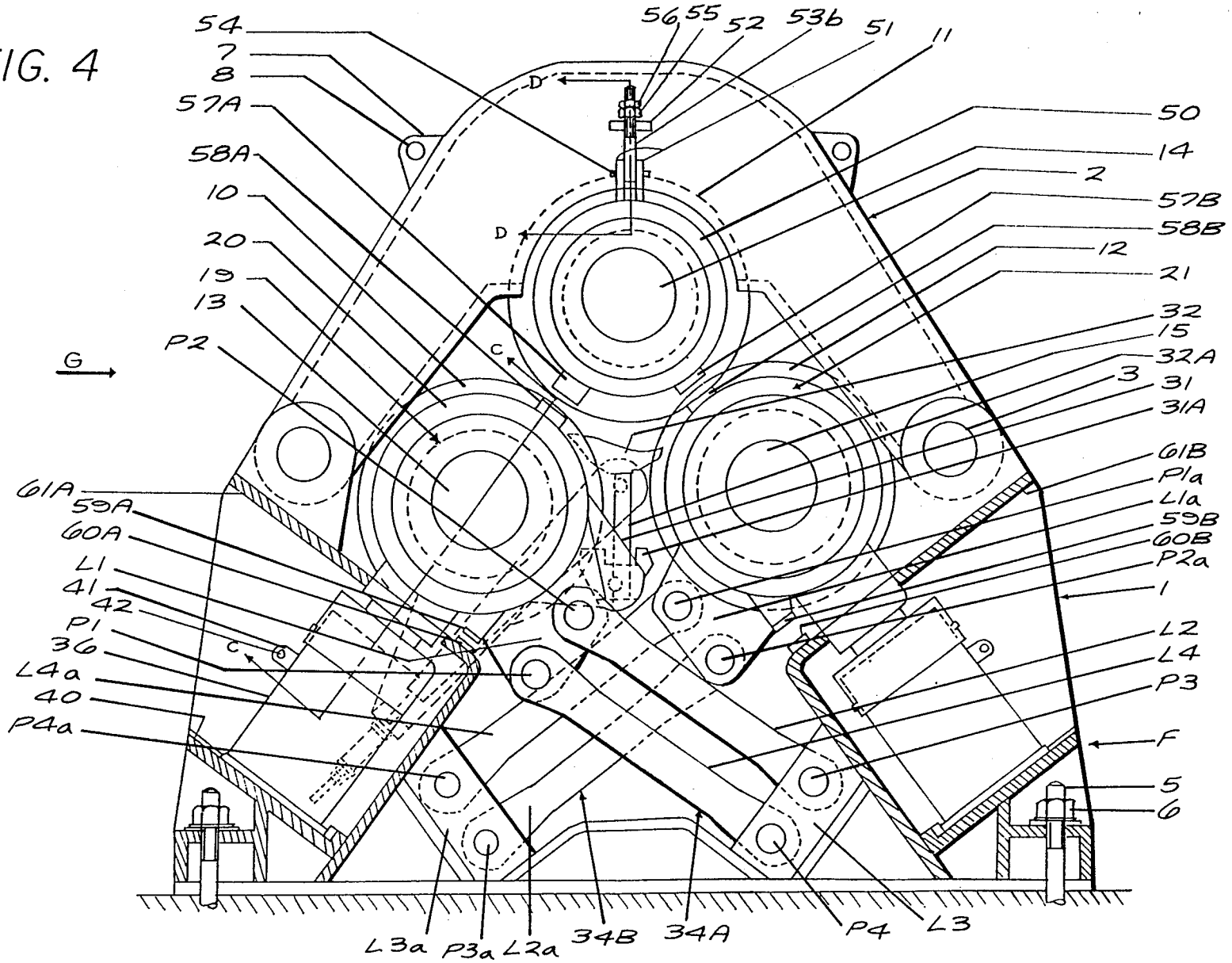
FIG. 4 is partially sectional side view of the mill of FIG. 1 in the direction 'B' in FIG. 1
Figure 5A:
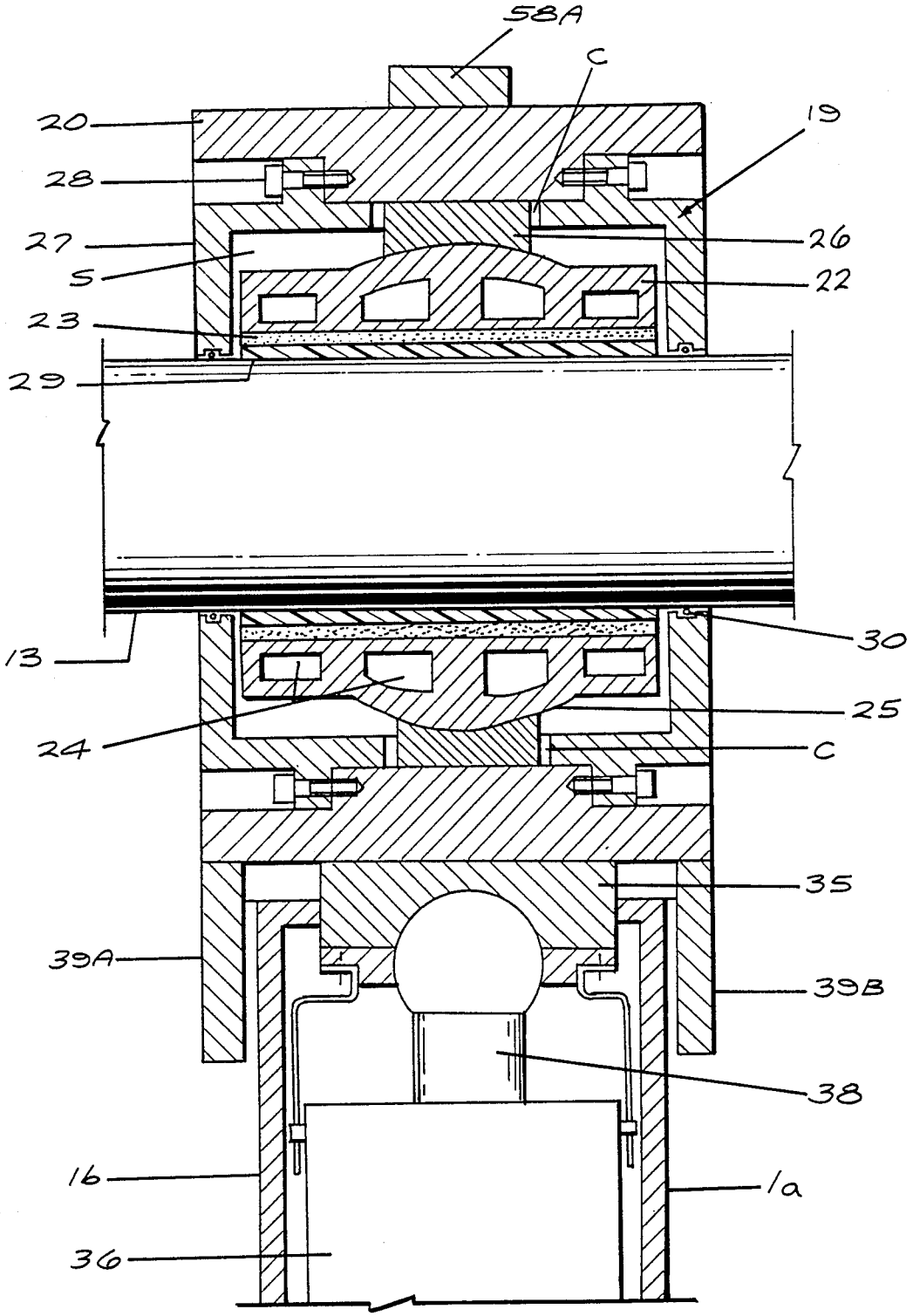
FIG. 5A is enlarged section at C—C in FIG. 4.
Figure 5C:
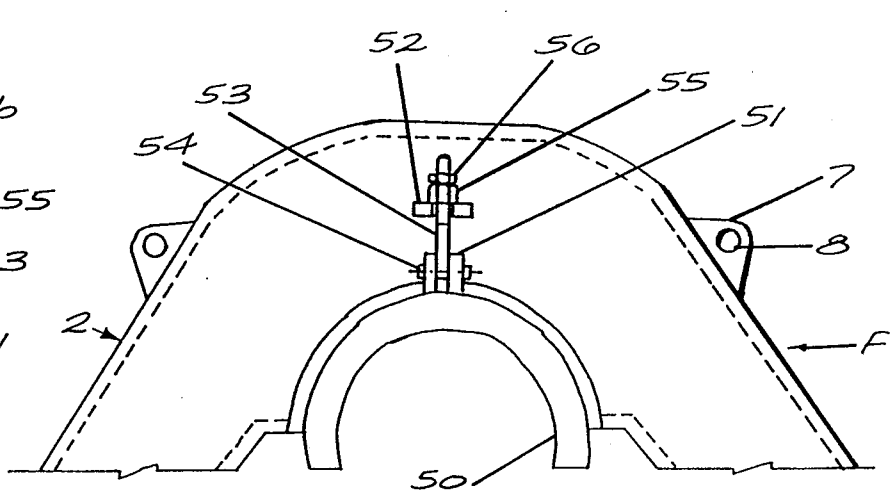
FIG. 5C is view in the direction Y in FIG. 5B.
Figure 5B:
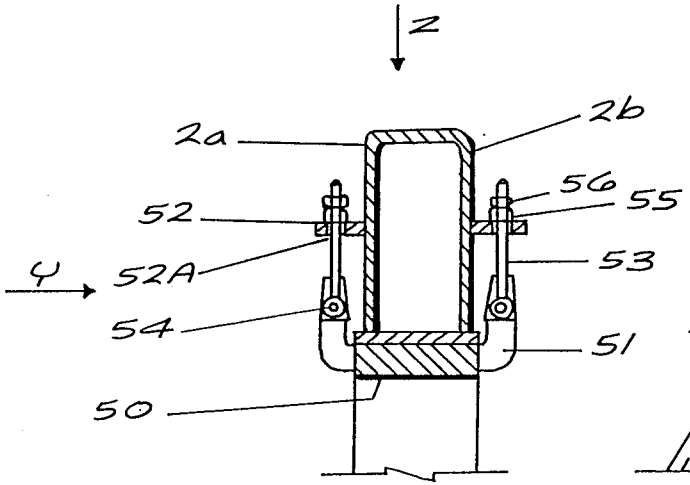
FIG. 5B is section at D—D in FIG. 4.
Figure 5D:
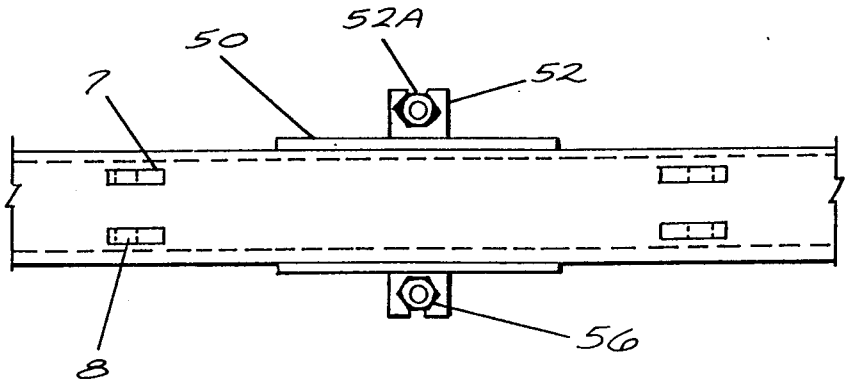
FIG. 5D is view in the direction Z in FIG. 5B.
Figure 7:
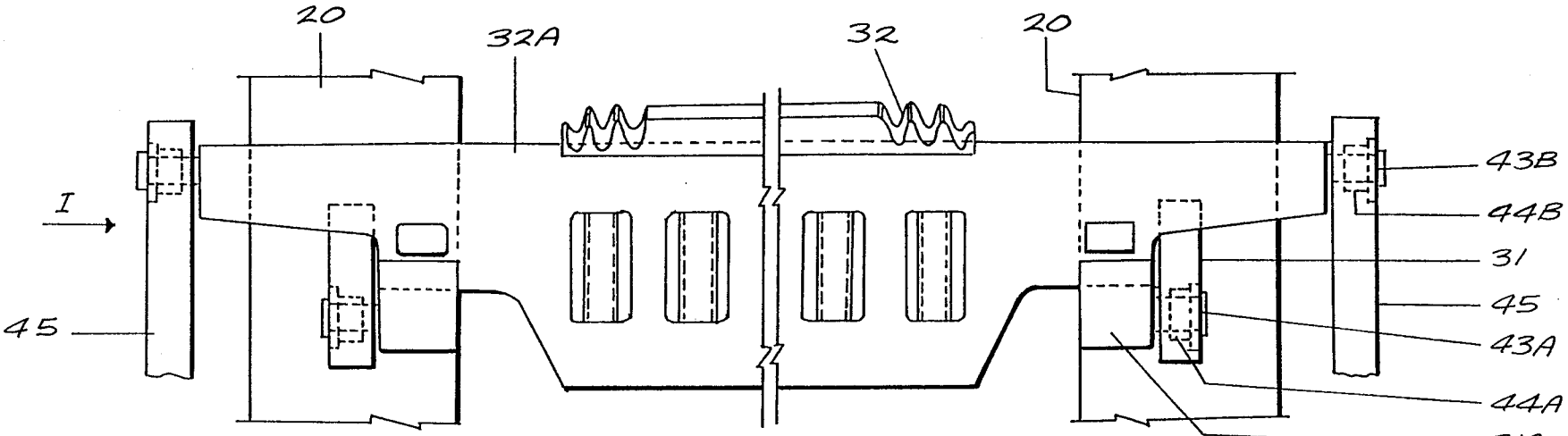
FIG. 7 is view of the trash plate of the mill of FIG. 1 from feedside in the direction 'G' in FIG. 4.
Figure 8A:
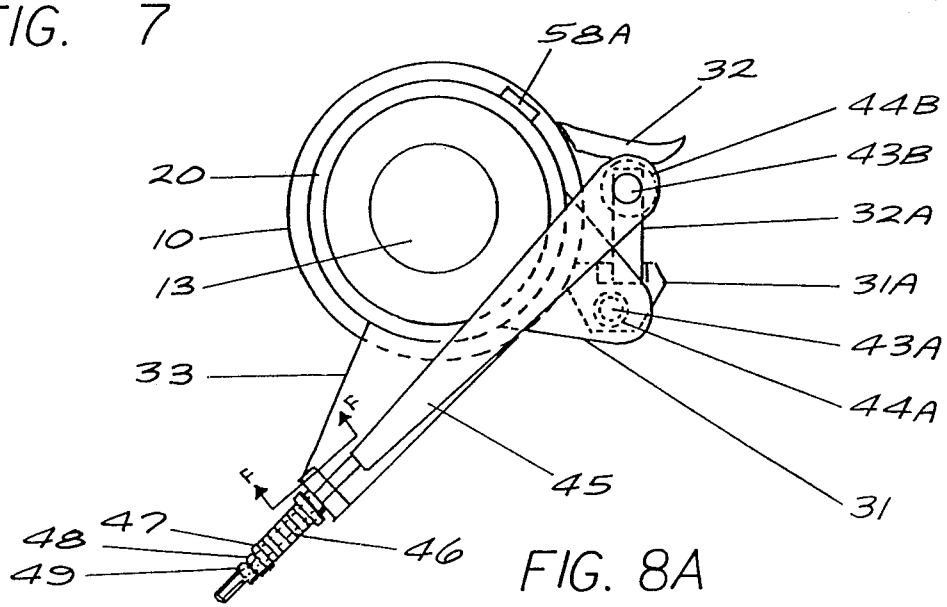
FIG. 8A is view of the trash plate in the direction 'I' in FIG. 7.
Figure 8B:
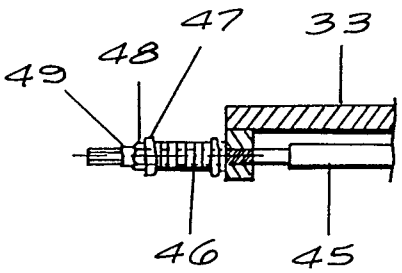
FIG. 8B is section at F—F in FIG. 8A.

Referring to the drawings, F is an upright frame comprising a lower part 1 and an upper part 2 removably fitted to the lower part 1 by pins 3 (See FIGS. 1, 3, 5C and 6). Both the lower part 1 and upper part 2 are double walled. Walls of lower part 1 are separately marked 1*a* and 1*b* and walls of upper part 2 are separately marked 2*a* and 2*b* (see FIG. 1). Lower part 1 is removably fixed to the ground marked 4 by foundation bolts 5 and nuts 6 which are accessible from outside. 7 are lifting brackets integrally formed with upper part 2. 8 is a hole provided in each lifting bracket 7 (See FIGS. 3 and 4). Brackets 7 facilitate lifting of upper part 2. Upper part 2 can be lifted by engaging hooks or the like in holes 8 of brackets 7. 9 is a cross beam at the top between the upper parts 2 in order to reinforce upper parts 2 (See FIG. 1). 10, 11 and 12 are feed roller, top roller and discharge roller respectively extending between frames F in a spaced apart relationship. The axes (not marked) of rollers 10, 11 and 12 are parallel to one another. 13, 14 and 15 respectively represent the shafts of rollers 10, 11 and 12. 16, 17 and 18 respectively are pinions rigidly supported on the drive end of feed roller, top roller and discharge roller (See FIGS. 1 and 2). Pinions 16 and 18 are in mesh with pinion 17. Shaft 13 of feed roller 10 is rotatably supported in a first pair of bearings 19 whose housings are marked 20 (See FIG. 4 and 5A). Similarly the shaft 15 of discharge roller 12 is rotatably supported in a second pair of bearings whose housings are marked 21 (See FIG. 4). Each of the first pair of bearings 19 and the second pair of bearings is a babit lined spherical seat bearing. Constructional details of a babit lined spherical seat bearing used with feed roller 10 is given in FIG. 5A. The babit lined spherical seat bearing consists of an inner race 22 provided with a babit lining 23, for instance, of white metal or gun metal at the inner surface thereof and coolant jackets 24 and a convex outer surface marked 25. The babit lined spherical seat bearing also consists of an outer race 26 provided with a concave inner surface (not marked but can be visualised in FIG. 5A) corresponding to the convex outer surface of the inner race 22 and located on inner race 22. 27 is a locating ring whereby outer race 26 is located in the respective bearing housing 20 using bolts 28. 29 is a removable sleeve supported on the respective shaft end and inner race 22 is mounted on sleeve 29. Locating ring 27 extends to the respective shaft end over inner race 22 and sleeve 29. 30 is an O-ring located between locating ring 27 and the respective shaft end. Locating ring 27 in association with O-ring 30 seals the bearing against leakage of foreign bodies such as dust particles, bagasse particles and cane juice thereinto. The space marked S (See FIG. 5A) between inner race 22 and locating ring 27 is filled with grease (not shown) or similar substance to seal the bearing further. As and when sleeve 29 wears out it can be replaced by a new sleeve. Thus wear and tear to the shaft end has been eliminated using sleeve 29. This will in turn increase the life of the respective shaft. The concave inner surface of outer race 26 provides a seat to the convex outer surface of inner race 22. Therefore, inner race 22 can slide in outer race 26 horizontally and angularly. Inner race 22 is cooled by circulating a coolant such as water (not shown) through the coolant jackets 24 therein. 31 is a lateral lug (see FIGS. 4, 7 and 8A) provided at the bottom of bearings housings 20 towards the trash plate side (trash plate is marked 32). 33 is a L-shaped lug provided at the bottom of bearing housing 20 and spaced apart from lug 31 (See FIGS. 4 and 8A). Trash plate side of housings 20 is supported on respective frames F by a pair of first parallelogram link mechanisms one of which is marked 34A and whose links are marked $L_1$, $L_2$, $L_3$ and $L_4$ and pivots are marked $P_1$, $P_2$, $P_3$ and $P_4$. The axes (not shown) of pivots $P_1$, $P_2$, $P_3$ and $P_4$ are parallel to the feed roller axis (See FIGS. 3 and 4). Similarly trash plate side of bearing housings 21 is supported on respective frames F by a pair of second parallelogram link mechanisms one of which is marked 34B and whose links are marked $L_{1a}$, $L_{2a}$, $L_{3a}$ and $L_{4a}$ and pivots are marked $P_{1a}$, $P_{2a}$, $P_{3a}$ and $P_{4a}$. The axes (not shown) of pivots $P_{1a}$, $P_{2a}$, $P_{3a}$ and $P_{4a}$ are parallel to the discharge roller axis (See FIG. 4). A clearance marked C is provided between outer race 26 and locating ring 27 (See FIG. 5A) to obtain sufficient play between outer race 26 and locating ring 27 along the axis of the feed roller or discharge roller, as the case may be, to facilitate cocking of the respective roller. 35 is a seat provided at the bottom of each of the bearing housings 20 and 21 (See FIGS. 5A and 6). Seat 35 is provided with a spherical socket not marked but can be visualised in FIGS. 5A and 6. 36 is a hydraulic cylinder whose ram and stem are marked 37 and 38 respectively (See FIGS. 1, 4, 5A and 6). Both the top end and bottom end of stem 38 are spherical (See FIG. 6). The spherical top end of stem 38 is engaged in the spherical socket provided in seat 35. The spherical bottom end of stem 38 is engaged in another spherical socket (not marked but can be visualised in FIG. 6) provided in ram 37. Cylinder 36 is connected to a constant rate recirculating type hydraulic pump (not shown since it is not necessary for the purpose of understanding the invention). Feed roller 10 and discharge roller 12 are thus independently separately supported on stems 38 through the respective bearing housings and are movable up and down by the respective hydraulic cylinders 36. Engagement of spherical top end and bottom end of stem 38 in the spherical socket in seat 35 and in the spherical socket in the ram provides universal joints or couplings between stem 38 and the respective bearing housing and the ram to accommodate cocking and/or wavering of the respective roller during its up and down movement. 39A and 39B are spaced apart downward projections depending from the bottom of bearing housings 20 (See FIG. 5A). Bearing housings 21 are also provided with similar downward projections but not shown in the drawings. Cylinder 36 is located between walls 1*a* and 1*b* of lower part 1 of each frame F against rib 40 (See FIGS. 1, 4 and 6). Cylinder 36 is provided with a lifting bracket 41. 42 is a hole provided in bracket 41 (See FIGS. 4 and 6). Bracket 41 facilitates handling of cylinder 36 in that a hook or the like (not shown) can be engaged in hole 42 and cylinder 36 can be lifted. Lower part 1 is engaged between downward projections 39A and 39B of each of bearing housings 20 and 21 to prevent lateral displacement of the respective bearing housing 20 or 21 and the respective roller during up or down movement and cocking thereof (See FIG. 5A in which bearing housing 20 has been shown). Trash plate 32 is of conventional construction (See FIGS. 4, 7 and 8A). 32A is the turn beam supporting trash plate 32. Turn beam 32A is pivotally supported on lugs 31 of bearing housings 20 through trunnions 31A using pins 43A and spherical plain bearings 44A housed in lugs 31.

Figure 9C:
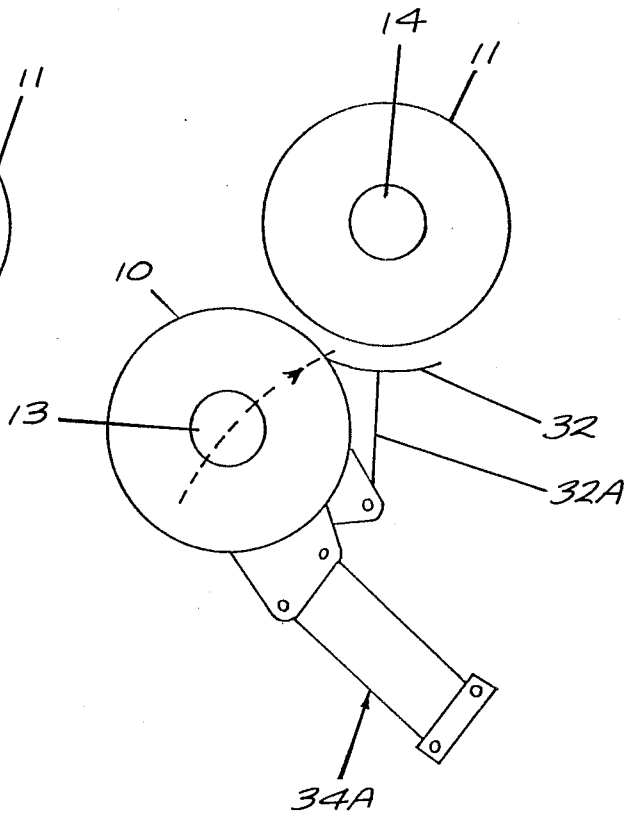
FIGS. 9A, 9B and 9C are line diagrams showing orientation of the trash plate with respect to the top roller at various feed rates.
Figure 9B:
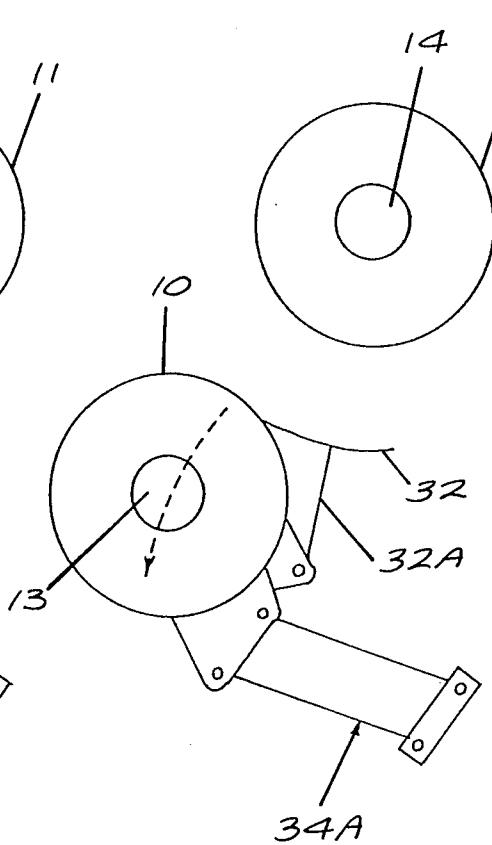
Figure 9A:
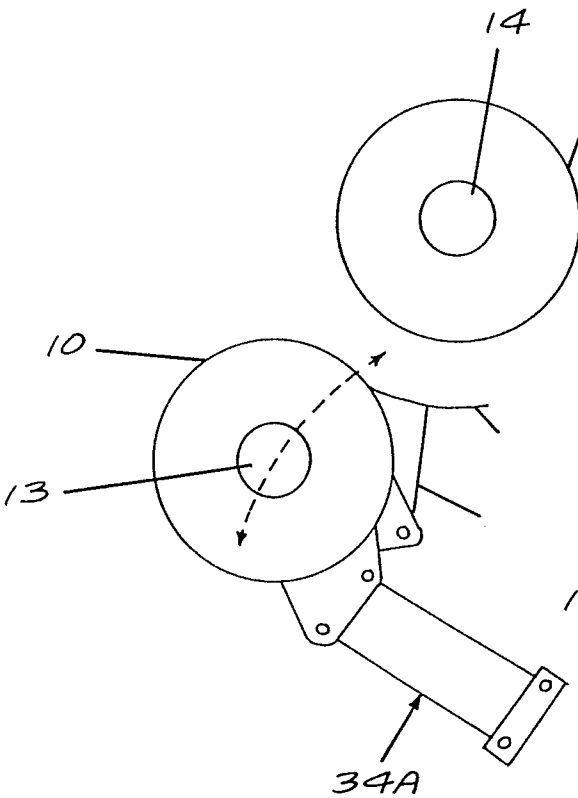
Figure 10:
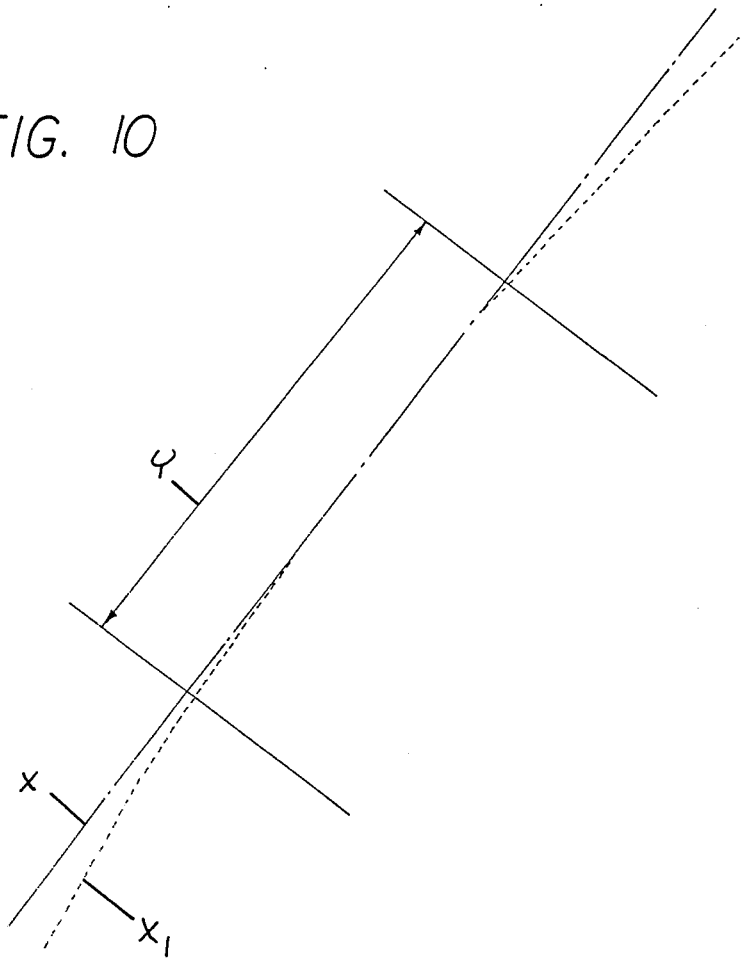
FIG. 10 is line diagram showing substantially linear movement of the feed roller along the axial plane during floating thereof within the effective operating range.

The axis passing through spherical plain bearings 44A is parallel to the feed roller axis. Sufficient space (not shown) is provided between lugs 31 and spherical plain bearings 44A along the axis passing through the bearings 44A in parallel to the feed roller axis to allow play between bearings 44A and lugs 31 and facilitate cocking of trash plate 32. 45 are levers one end each of which is pivoted on turnbeam 32A using pins 43B and spherical plain bearings 44B (See FIGS. 7 and 8A). The other end each of levers 45 is supported in L-shaped lugs 33 of bearing housings 20 and loaded with springs 46. 47 is a spherical washer and 48 and 49 are nut and checknut, respectively. By tightening nut 48 on spring 46 it can be compressed against washer 47 and trash plate 32A can be stressed on feed roller 10 and thus the scraping pressure of trash plate on feed roller 10 can be adjusted. Nut 48 is locked in position by checknut 49. Instead of spring 46, pneumatic or hydraulic actuator (not shown) are known to be used and can be used as per the present invention to bias trash plate 32 against feed roller 10. Since feed roller 10 and discharge roller 12 are loaded by constant hydraulic pressure being transmitted by the respective hydraulic pumps through the respective stems and bearings housings, the feed roller and discharge roller move up and down responsive to change in feed separately independently. The feed opening and discharge opening thus get independently adjusted for desired crushing pressures depending on the feed and fiber rate. As the feed roller and discharge roller move up and down the respective parallelogram linkage mechanisms guide the up and down movement thereof substantially linearly within the effective operating range namely the range falling between the normal feed rate, increased feed rate and decreased feed rate (See FIGS. 9A, 9B and 9C and FIG. 10) along the plane joining the feed roller and top roller axes and along the plane joining the discharge roller and top roller axes respectively. The substantially linear up and down movement of the feed roller maintains the orientation of the trash plate with respect to the top roller even during cocking. See FIGS. 9A, 9B and 9C in which the movement of the feed roller and orientation of the trash plate with respect to the top roller have been shown. FIG. 9A shows the trash plate and feed roller at normal feed rate. FIGS. 9B and 9C show the trash plate and feed roller at increased feed rate and decreased feed rate, respectively. FIG. 10 is further illustrative of the substantially linear movement of the feed roller within the effective operating range illustrated in FIGS. 9A, 9B and 9C. In FIG. 10, the feedside axial plane (line joining the feed roller axis and top roller axis) under normal feed rate is marked X and the path described by the feed roller axis during the up and down movement of the feed roller is marked $X_1$. The effective operating range is marked Y. As can be seen in FIG. 10, the feed roller moves practically linearly while floating due to which the trash plate orientation with respect to the top roller at any position of the feed roller is maintained.

Figure 11:
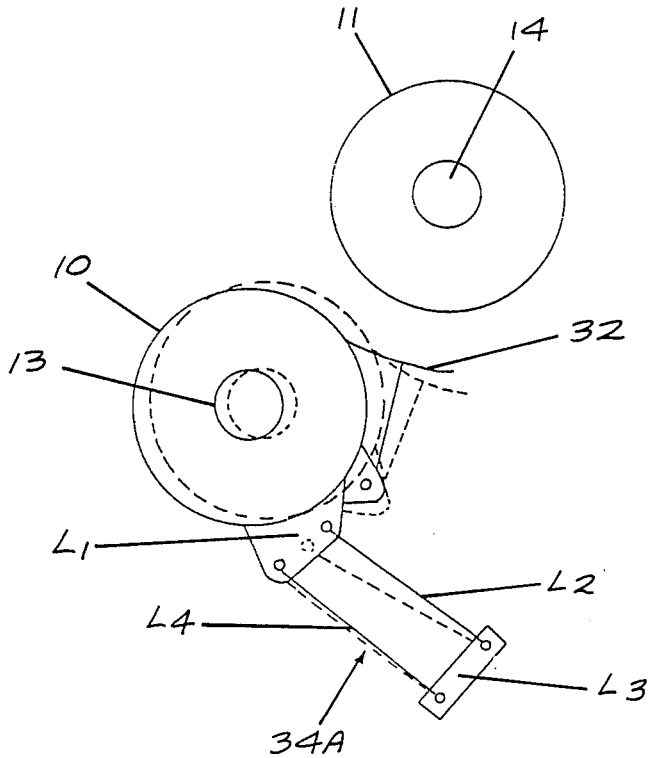
FIG. 11 is line diagram showing variation in the trash plate orientation with respect to the top roller when the length of one of the links of the first parallelogram link mechanisms associated with the feed roller is reduced.

By varying the length of one or more links of the first parallelogram link mechanisms desired trash plate orientation with respect to the top roller can be achieved during floating of the feed roller. This has been illustrated in FIG. 11 which shows by dotted line diagram that when the effective length of link $L_1$ is reduced the trash plate orientation with respect to the top roller is changed. Such variation is within the scope of the present invention and the scope of the present invention should be construed accordingly.

Top roller 11 is rotatably supported in a pair of bearings whose housings are marked 50 (See FIGS. 4, 5B, 5C and 5D). Bearing housings 50 are supported on upper part 2 of frames F as follows. Bearing housings 50 are provided with two pairs of upwardly directed spaced apart members 51, each pair being disposed on each side of upper part 2. Walls **2*a* and 2*b* of upper part 2 are provided with a pair of lateral projections 52 confronting corresponding pairs of members 51. Projections 52 each is provided with an open slot 52A. 53 represents studs engaged in open slots 52A of projections 52 and between pairs of members 51. Studs 53 are locked to pairs of members 51 by pins 54 secured through lateral holes in pairs of members 51 and through holes in studs 53. Holes in pairs of members 51 and studs 53 have not been marked but can be visualised in FIGS. 4, 5B and 5C. Bearing housings 50 can be tightened against projections 52 and hence upper part 2 by nuts 55 and locked by checknuts 56. The position of top roller 11 is thus fixed. 57A and 57B are first stoppers provided at the bottom of top roller bearing housings 50 (See FIG. 4). 58A and 58B are also first stoppers provided at the upper surface of feed roller and discharge roller bearing housings 20 and 21 respectively (See FIGS. 4, 5A and 6). Stopper 58A abuts stopper 57A to limit the upward movement of feed roller 10. Similarly stopper 58B abuts stopper 57B to limit the upward movement of discharge roller 11. 59A is a second stopper provided at the bottom of feed roller bearing housing 20 (See FIG. 4). 60A is also a second stopper provided on a rib 61A in lower part 1 of frame F (See FIG. 4). Stopper 59A abuts stopper 60A to limit the downward movement of feed roller 10. Similarly second stoppers 59B and 60B provided at the bottom of discharge roller bearing housing 21 and on a rib 61B in lower part 1 of frame F respectively limit the downward movement of discharge roller 11. (See FIGS. 4 and 6). Upward and downward movements of feed roller 10 and discharge roller 11 can be further limited by providing packing material such as packing plates (not shown) between stoppers 57A and 58A, 57B and 58B, 59A and 59B and/or 60A and 60B**.

Figure 1:
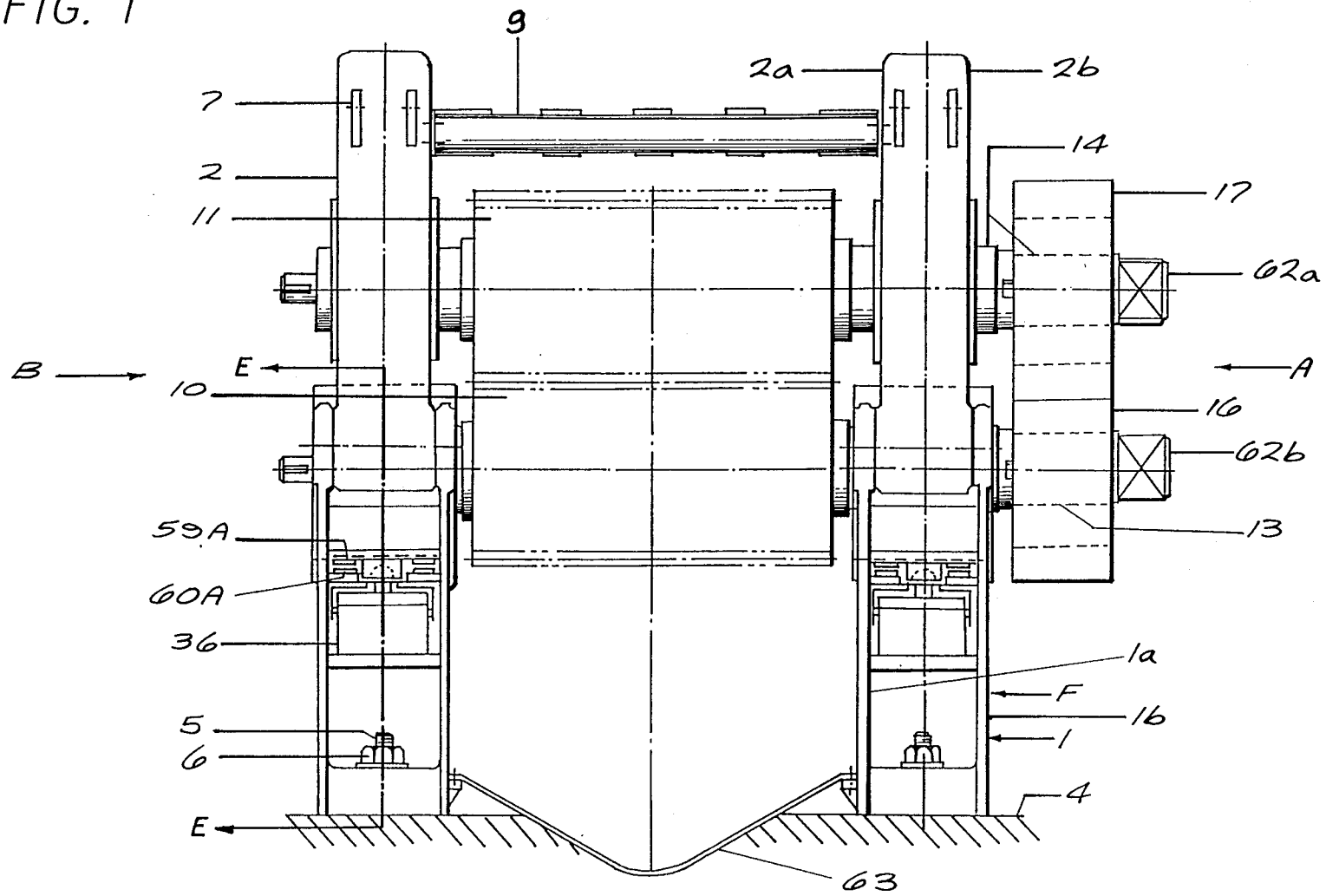
FIG. 1 is feed side view of the improved mill according to an embodiment of the present invention.
Figure 3:
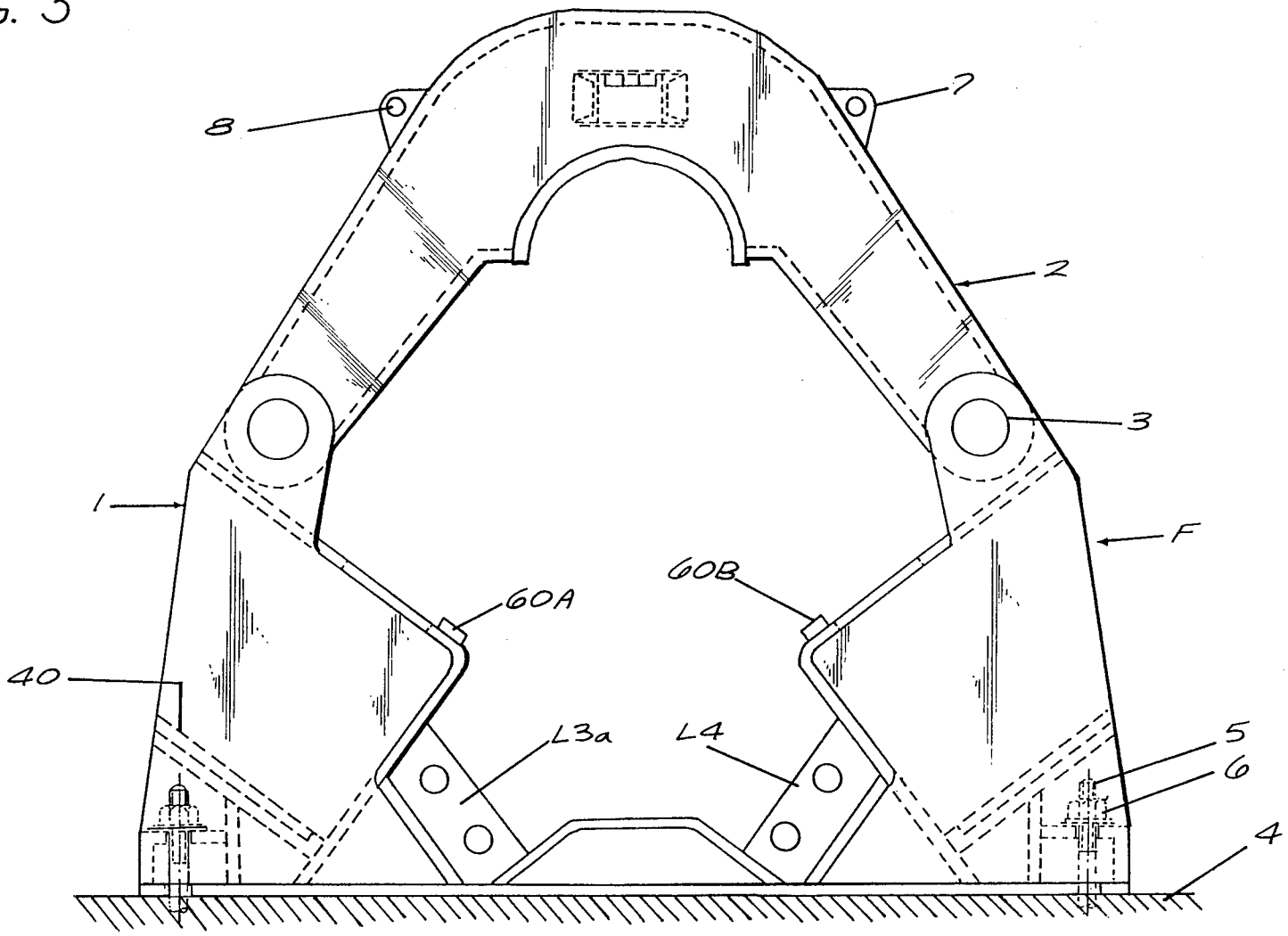
FIG. 3 is view of one of the upright frames of the mill of FIG. 1.

Drive to the mill is given through the top roller 11 and for this purpose drive end of the top roller shaft 14 is connected to a prime mover such as steam turbine or electric or hydraulic motor (not shown) through tail bar and box coupling assembly (not shown) and gearing (not shown) as in the case of conventional mill. One of the box couplings mounted at the drive end of the top roller shaft 14 has been shown in FIG. 1 and is marked 62A. The drive end of the feed roller 10 is also provided with a box coupling 62B (See FIG. 1) so that the feed roller and top roller can be interchanged if necessary. In FIG. 1, 63 is the juice tray.

Features or parts such as grooves on the feed roller, top roller and discharge roller, under feed roller, Meschaert knives, scrappers associated with the top roller and discharge roller and Donally chute have not been shown in the drawings as such features or parts are conventional and are not required for understanding the present invention The above embodiments are by way of examples and should not be construed to be limitative of the scope of the present invention.

The main advantage of the improved mill is that the feed roller is independently loaded with constant pressure imparting means and is movable up and down substantially linearly along with the trash plate mounted thereon responsive to change in feed and that the trash plate orientation with respect to confronting top roller surface is maintained at all positions of the feed roller. Consequently the gap between top roller and tail-end of the trash plate reduces or increases in direct proportion to the gap between the top roller and lead-end of the trash plate thereby eliminating chances of choke up of the feed between the top roller and tail-end of the trash plate and rolling of the feed over the tail-end of the trash plate instead of getting transfered onto the discharge roller.

Another advantage of the improved mill is that since the feed roller and discharge roller are independently loaded with constant pressure imparting means, the feed opening and discharge opening get adjusted independently responsive to feed rate thereby improving extraction efficiency of the mill.

Another advantage of the improved mill is that since orientation of the trash plate with respect to the top roller and its contact with the feed roller is maintained at all positions of the feed roller, set scrapping contact and scrapping pressure between the feed roller and trash plate remain undisturbed during uneven lift of the feed roller along its length ensuring smooth operation of the mill and optimum juice extraction at varying feed rates and blanket thickness along the roller length.

Another advantage of the improved mill is that due to the parallelogram link mechanism, the bearing housings associated with the feed roller and discharge roller remain fixed in orientation with reference to space though the links are having angular movement. The angular movement of the links is thus compensated by opposite movement of the bearings which maintain the roller surface speed unaffected. Consequently there will be no shearing or slippage of bagasse and wastage of power or reduction in mill capacity.

Another advantage of the improved mill is that a desired change in the orientation of the trash plate with respect to the top roller can be obtained quickly by varying the effective length of one or more links of the first parallelogram link mechanisms without the need for changing the trash plate.

Another advantage of the improved mill is that it readily facilitates interchangeability of the babit lined spherical seat bearings used for the feed and discharge rollers with spherical antifriction bearings in that the space required by both is the same.

Another advantage of the improved mill is that since the feed roller is independently loaded with constant pressure imparting means and the trash plate is mounted thereon and is movable therewith bagasse reaction on the trash plate is reduced considerably compared to the conventional mills. Reduction in bagasse reaction may be of the order of 25 to 35%. Consequently power required for countering the bagasse reaction on the trash plate is correspondingly reduced. The power thus saved may be of the order of 25 to 35%. This power which would have otherwise been wasted in countering the bagasse reaction on the trash plate is now available for extraction thereby improving power utilization and extraction efficiency of the mill.

Another advantage of the improved mill is that since the top roller position is fixed and the top roller is not hydraulically loaded, there is no friction between the bearings associated with the top roller and the housings thereof as in the case of the bearings and housings of hydraulically loaded floating type conventional top rollers. Since such friction has been eliminated power required for overcoming such friction is saved and is available for extraction. This power saving may be of the order of 5 to 10%. Furthermore such friction causes excessive wear and tear and heating of the conventional top roller bearings and the housings thereof. Besides affecting the ratio of feed opening to discharge opening, such wear and tear necessitate frequent replacement of the conventional top roller bearings and the housings thereof adding to the running cost of the mill. Thus power utilisation and extraction efficiency of the mill is improved and the running cost of the mill is reduced.

Another advantage of the improved mill is that since the top roller position is fixed and the top roller is not hydraulically loaded there is no misalignment between the centre line of the top roller and the centre line of the tail bar and box coupling assembly and the last motion gear wheel shaft of the gearing as in the case of hydraulically loaded floating type conventional top roller. Such misalignment gives rise to numerous problems, for instance, development of undesirable forces on the tail bar and box coupling assembly and last motion gear wheel shaft of the gearing and excessive wear and tear to the top roller shaft and tail bar and box coupling assembly due to friction. In the improved mill all these problems have been eliminated. The improved mill thus ensures trouble free operation besides being economical.

We claim:

1. An improved sugar cane mill comprising a mill housing comprising of a pair of spaced apart upright frames fixed to the ground, a feed roller, a top roller and a discharge roller extending between said frames in a spaced apart relationship, the axes of said feed roller, top roller and discharge roller being parallel to one another, said mill including a trash plate disposed and extending between said feed roller and discharge roller, said feed roller being rotatably supported in a first pair of bearings, the housings of said first pair of bearings each being provided with a lateral lug at the bottom thereof towards the trash plate side, the trash plate side of the housings of said first pair of bearings being supported on the respective frames by at least one pair of first parallelogram link mechanisms, the pivot axes of said first parallelogram link mechanisms being parallel to the axis of said feed roller, said first parallelogram link mechanisms guiding the up and down movement of the housings of said first pair of bearings and the feed roller substantially linearly, the housings of said first pair of bearings being supported on and moved up and down by a pair of first constant pressure imparting means accommodated in the respective frames, said discharge roller being rotatably supported in a second pair of bearings, the trash plate side of the housings of the second pair of bearings being supported on the respective frames by at least one pair of second parallelogram link mechanisms, the pivot axes of said second parallelogram link mechanisms being parallel to the axis of said discharge roller, said second parallelogram link mechanisms guiding the up and down movement of the housings of said second pair of bearings and the discharge roller substantially linearly, the housings of said second pair of bearings being supported on and moved up and down by a pair of second constant pressure imparting means accommodated in the respective frames, said top roller being rotatably supported in a third pair of bearings, the housings of said third pair of bearings being mounted in said frames, the drive end of said top roller being coupled to a prime mover through a tail bar and box coupling assembly and gearing, the position of said top roller being fixed during operation of said mill, said trash plate being pivotally supported on said lateral lugs and abutting said feed roller and biased towards said feed roller, the axis passing through the pivots of said trash plate being parallel to the feed roller axis, said trash plate being movable up and down with said feed roller maintaining the set scrapping contact with said feed roller and the orientation thereof with respect to the confronting top roller surface, first stoppers being provided at the bottom of the housings of said third pair of bearings and at the confronting upper surface of the housings of said first pair of bearings and second pair of bearings to limit the upward movement of said feed roller and discharge roller and second stoppers being provided at the bottom of the housings of said first pair of bearings and said second pair of bearings and at the confronting surfaces of said frames to limit the downward movement of said feed roller and said discharge roller.

2. A mill as claimed in claim 1, wherein each of said frames is double walled and comprises a lower part and an upper part removably fitted to the lower part.

3. A mill as claimed in claim 2, wherein each of said first and second pressure imparting means includes hydraulic cylinder with ram and stem and a constant rate recirculating type hydraulic pump connected to said hydraulic cylinder, and the housing of each of the first pair of bearings and second pair of bearings is provided with a pair of spaced apart downward projections depending from the bottom thereof, said cylinder being provided with lifting bracket with hole and located between the walls of said lower part, the walls of said lower part being engaged between said downward projections.

4. A mill as claimed in claim 3, wherein each of the top end and bottom end of said stem is spherical, the spherical top end of said stem being engaged in a spherical socket provided in a seat at the bottom of the housing of each of the first and second pair of bearings to provide a universal joint or coupling between the stem and respective bearing housing and the spherical bottom end of said stem being engaged in another spherical socket provided in said ram to provide a universal joint or coupling between said stem and said ram.

5. A mill as claimed in claim 1, wherein said frames are fixed to the ground using foundation bolts accessible from outside of said frames.

6. A mill as claimed in claim 1, wherein said frames are provided with lifting brackets with holes.

7. A mill as claimed in claim 1, wherein each of said first pair of bearings and second pair of bearings is a babit lined spherical seat bearing adapted to be interchangeable with a spherical antifriction bearing.

8. A mill as claimed in claim 7, wherein said babit lined spherical seat bearing consists of an inner race provided with a babit lining at the inner surface thereof and coolant jackets therein and a convex outer surface and an outer race provided with a concave inner surface corresponding to the convex outer surface of said inner race and located on said inner race, said bearing including a locating ring enclosing said bearing and adapted to be located in the respective bearing housing and associated with an O-ring to seal said bearing against leakage thereinto when mounted on the shaft of the respective feed or discharge roller, a clearance being provided between said outer race and said locating ring to obtain sufficient play between said outer race and said locating ring along the axis of the respective roller to facilitate cocking of the respective roller and the housings of said first pair of bearings, each bearing housing is provided with a L-shaped lug at the bottom thereof spaced apart from said lateral lug and said trash plate includes a turnbeam which is pivotally supported on said lateral lugs through trunnions using pins and spherical plain bearings housed in said lateral lugs, said trash plate being spring biased towards said feed roller by loading a spring at one end of a lever supported in said L-shaped lug, the other end of said lever being pivoted on the turn beam of said trash plate, sufficient space being provided between said lateral lugs and said spherical plain bearings along the axis passing through said spherical plain bearings in parallel to the feed roller axis to allow play between said spherical plain bearings and said lateral lugs and facilitate cocking of said trash plate along with the feed roller.

9. A mill as claimed in claim 8, wherein said inner race is mounted on a removable sleeve located on the shaft of the respective feed or discharge roller.

10. A mill as claimed in claim 1, wherein said prime mover is a steam turbine engine.

11. A mill as claimed in claim 1, wherein said prime mover is an electric motor.

12. A mill as claimed in claim 1, wherein said prime mover is a hydraulic motor.

* * * * *